US008978427B2

(12) United States Patent
Ho et al.

(10) Patent No.: US 8,978,427 B2
(45) Date of Patent: Mar. 17, 2015

(54) TAMPER RESISTANT SECURITY TAG

(71) Applicants: Wing Kei Ho, Boynton Beach, FL (US); Gopal Chandramowle, Boca Raton, FL (US)

(72) Inventors: Wing Kei Ho, Boynton Beach, FL (US); Gopal Chandramowle, Boca Raton, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 14/072,454

(22) Filed: Nov. 5, 2013

(65) Prior Publication Data

US 2014/0123714 A1 May 8, 2014

Related U.S. Application Data

(60) Provisional application No. 61/722,640, filed on Nov. 5, 2012.

(51) Int. Cl.
*E05B 73/00* (2006.01)
*E05B 47/00* (2006.01)

(52) U.S. Cl.
CPC ..... *E05B 73/0017* (2013.01); *E05B 73/0005* (2013.01); *E05B 73/0052* (2013.01); *E05B 2047/0093* (2013.01)
USPC ..... 70/57.1; 70/14; 70/30; 70/49

(58) Field of Classification Search
CPC ..... E05B 73/0017; E05B 73/0052; E05B 45/005; E05B 73/00; E05B 73/0005; E05B 73/0029; E05B 81/14; E05B 47/00; E05B 75/00; E05B 71/00; E05B 67/003; E05B 69/00; E05B 65/00; E05B 65/52; E05B 15/0046; E05B 47/0002; E05B 73/0023; E05B 17/2084; G08B 13/2434; G08B 13/1463; G08B 13/2402; G08B 13/2405; G08B 13/2408; G08B 13/2411; G08B 13/2414; G08B 13/2417; G08B 13/242; B65D 2211/00
USPC ..... 70/57.1, 30, 49, 14, 18; 206/1.5
See application file for complete search history.

(56) References Cited

U.S. PATENT DOCUMENTS

| | | | | |
|---|---|---|---|---|
| 1,851,207 | A * | 3/1932 | Neal | 70/16 |
| 3,907,255 | A * | 9/1975 | McElroy | 24/136 R |
| 5,079,540 | A * | 1/1992 | Narlow et al. | 340/572.8 |
| 5,291,761 | A * | 3/1994 | Lii | 70/18 |
| 5,791,170 | A * | 8/1998 | Officer | 70/49 |
| 6,609,399 | B1 * | 8/2003 | Daniels, Jr. | 70/49 |
| 6,755,450 | B1 * | 6/2004 | Chen | 292/295 |

(Continued)

*Primary Examiner* — Suzanne Barrett
(74) *Attorney, Agent, or Firm* — Robert J. Sacco, Esq.; Fox Rothschild LLP

(57) ABSTRACT

Security tag includes a housing and a movable locking element. A latch within the housing is resiliently biased toward the movable locking element and movable responsive to a magnetic field between a locked position and an unlocked position. A guide structure is arranged to constrain movement of the latch. The latch and the guide structure are cooperatively arranged to ensure an engagement that will disrupt a motion trajectory of the latch occurring when the housing is subjected to a physical impact. Consequently, the latch is selectively inhibited from moving fully from the locked position to the unlocked position when the housing is subjected to the physical impact.

20 Claims, 6 Drawing Sheets

(56) References Cited

U.S. PATENT DOCUMENTS

| | | | | |
|---|---|---|---|---|
| 7,961,099 | B2 * | 6/2011 | Rendon et al. | 340/572.1 |
| 8,179,267 | B2 * | 5/2012 | Anderson et al. | 340/572.9 |
| 8,264,350 | B2 * | 9/2012 | Perez et al. | 340/568.1 |
| 8,294,583 | B2 * | 10/2012 | Sayegh et al. | 340/572.9 |
| 8,578,743 | B2 * | 11/2013 | Yu | 70/30 |
| 2008/0258478 | A1 * | 10/2008 | Lopez et al. | 292/251.5 |
| 2009/0128331 | A1 * | 5/2009 | Lopez et al. | 340/572.1 |
| 2009/0278691 | A1 * | 11/2009 | Valade | 340/572.8 |

* cited by examiner

TAMPER RESISTANT SECURITY TAG

CROSS REFERENCE TO RELATED APPLICATIONS

This application is a non-provisional application claiming the benefit of U.S. Provisional Application No. 61/722,640 filed on Nov. 5, 2012, the entirely which is incorporated herein by reference.

BACKGROUND OF THE INVENTION

1. Statement of the Technical Field

The inventive arrangements relate to security tags attachable to articles of merchandise, and more particularly a security tag having an improved locking mechanism providing greater defeat resistance.

2. Description of the Related Art

Electronic article surveillance (EAS) systems are well known in the art and are used for inventory control and to prevent theft and similar unauthorized removal of articles from a controlled area. Typically, in such systems a system transmitter and a system receiver are used to establish a surveillance zone, which must be traversed by any article being removed from the controlled area.

An EAS tag is security tag affixed to each article and includes a marker or sensor adapted to interact with a signal being transmitted by the system transmitter into the surveillance zone. This interaction causes a further signal to be established in the surveillance zone, which further signal is received by the system receiver. Accordingly, upon movement of a tagged article through the surveillance zone, a signal will be received by the system receiver, identifying the unauthorized presence of the tagged article in the zone. The security tags are designed to be releasable only by a specially designed implement.

Security tags used in EAS systems often include a locking mechanism which serves to affix the tag to an article. The tag may be locked to the article itself, or the tag can be configured as mated components, which are attachable to one another with a portion of the article secured between the tag components. A common locking arrangement used in security tags is a magnetically-actuatable locking mechanism. These types of security tags use a magnet to unlock the locking mechanism. The magnet interacts with the magnetic components in the lock and actuates such magnetic components to unlock the mechanism.

SUMMARY OF THE INVENTION

The invention concerns a tamper-resistant security tag which includes a housing and a movable locking element disposed within the housing. A latch is disposed within the housing and is resiliently biased toward the movable locking element. The latch is movable responsive to application of a magnetic field between a locked position, in which movement of the locking element is prevented by the latch, and an unlocked position, in which movement of the locking element is unrestricted by the latch. A guide structure is provided within the housing and is arranged to constrain a movement of the latch. The latch and the guide structure are cooperatively arranged to facilitate engagement between at least one portion of the guide structure and a portion of the latch. These portions of the latch and the guide structure are strategically arranged to ensure that the engagement will disrupt a motion trajectory of the latch occurring when the housing is subjected to a physical impact. Consequently, the latch is selectively inhibited from moving fully from the locked position to the unlocked position when the housing is subjected to the physical impact.

The invention also concerns a method for preventing defeat of a security tag in a security tag as described herein. The method involves disrupting with the guide structure a motion trajectory of the latch occurring when the housing is subjected to a physical impact so that the latch is selectively inhibited from moving fully from the locked position to the unlocked position only when the housing is subjected to the physical impact. The kinetic energy of the latch associated with such motion trajectory is effectively wasted within the housing by the motion disrupting action of the guide structure.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

EAS type security tags commonly include a magnetically-actuatable locking mechanism. In such locking mechanisms, the magnetic component of the lock requires a certain mass to generate a sufficient magneto-mechanical response for unlocking the tag. However, it has been found that the mechanical response generated by the unlocking magnet can be duplicated by application of external mechanical force. Application of a sufficient external force (as may be done in an attempt to defeat the tag) could result in the unlocking of the tag. A tag which can be defeated in this manner is obviously undesirable in EAS applications. It is challenging to produce a defeat resistant magnetic lock without compromising the magnetic detach or adding too much cost to the design due to added complexity. Prior solutions include the use of a stronger spring to hold the magnetic component in place. However, the use of stronger springs can cause detaching failure under conditions of authorized tag detachment, or can otherwise require a stronger and more expensive detacher device magnet.

Figure 1A:
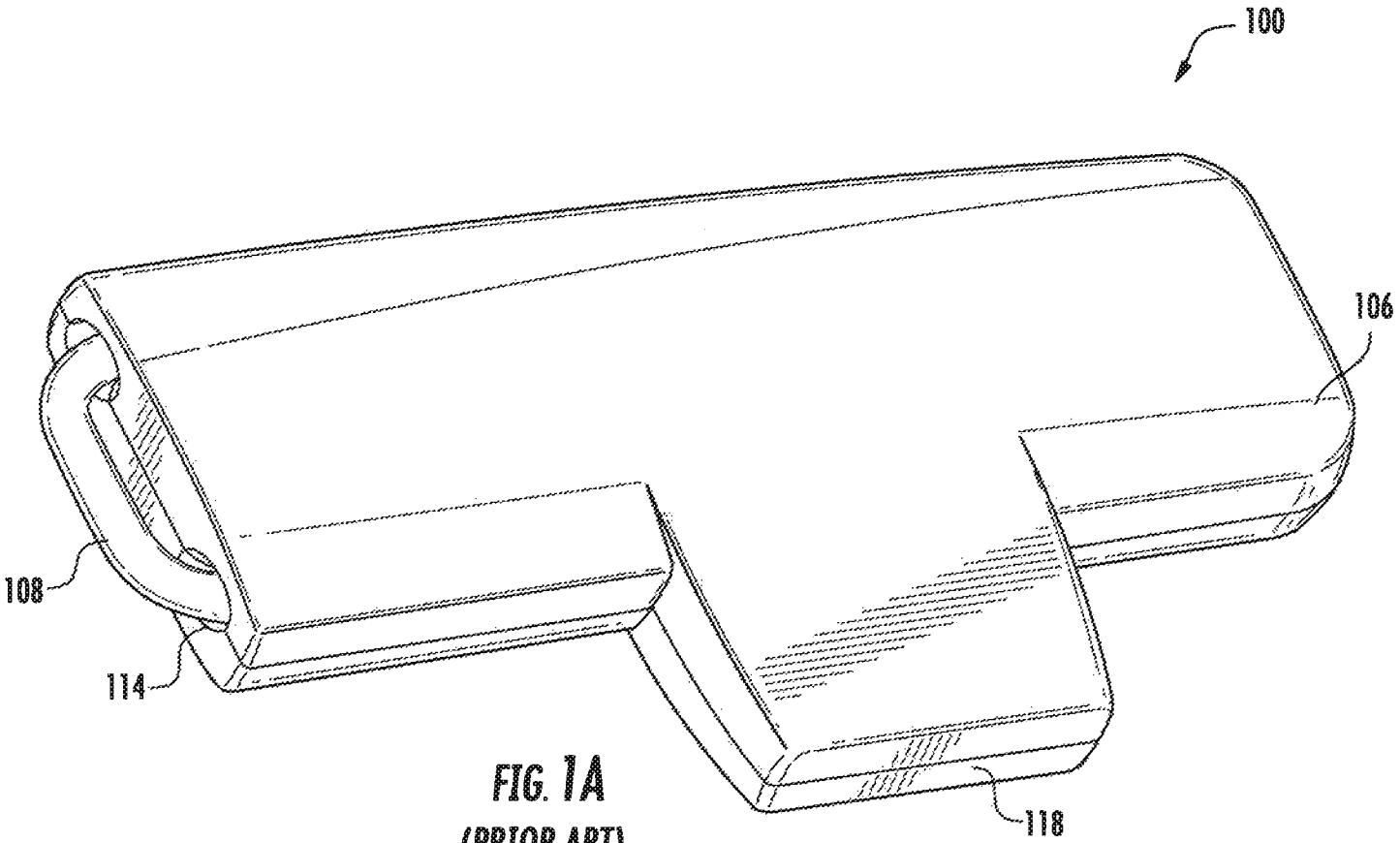
FIG. 1A (PRIOR ART)
FIG. 1A is a perspective view of a security tag with a prior art magnetic locking mechanism.
Figure 1B:
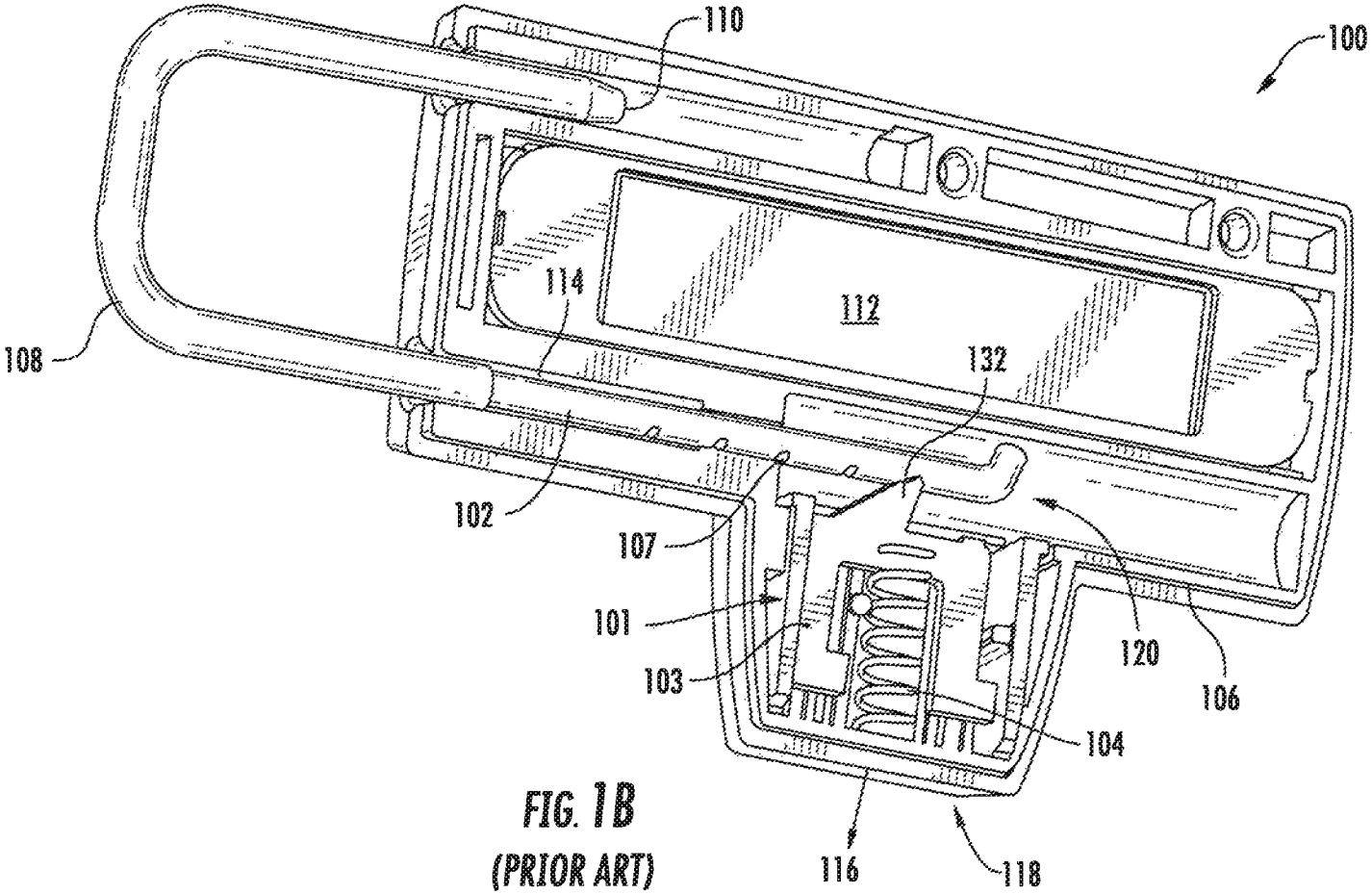
FIG. 1B (PRIOR ART)
FIG. 1B is a cutaway view showing internal components of the security tag in FIG. 1A.

FIGS. 1A and 1B are illustrative of a conventional security tag 100 showing a prior art magnetic locking mechanism 101. The security tag 100 includes an EAS element 112 which can be detected using conventional EAS methods. The locking mechanism 101 includes an elongated pin 102, a latch 103 to engage the pin 102 by engagement with at least one catch 107 disposed therein. The catch can be a groove or any other suitable mechanical structure formed in the pin and which is capable of locking engagement with the latch as hereinafter described. The locking mechanism also includes a spring 104 to bias the latch 103 toward the pin 102. A rigid plastic housing 106 can contain the locking mechanism. When the latch is in a locked position as shown, a cog or tooth 132 formed on the latch engages the catch provided in the pin. This engagement prevents the pin from moving within a pin channel 114. The latch 103 is formed of a material that is responsive to an applied magnetic field. In this regard, the material is generally selected so as to contain iron. Accordingly, an exemplary material that can be used for this purpose is steel. In the tag shown in FIG. 1B, detaching is accomplished with a detaching device which positions a detacher magnet (not shown) under a base portion 118 of the housing which encloses the latch. As a result of the applied magnetic field from the detacher magnet, the latch 103 experiences a downward attractive magnetic force in a direction 116 which overcomes the bias of the spring 104. The latch 103 translates downward, disengaging the latch 103 from the pin 102 and thus unlocking the tag. Once unlocked, the pin 102 can slide within the pin channel 114 in the direction indicated by arrow 120 so that an end portion 110 of shackle 108 can clear the housing. Once the end portion 110 has cleared the housing, an item secured within the shackle can be released.

A drawback of the locking arrangement of FIG. 1B is that the action of striking the bottom of the tag against a hard surface will sometimes cause the same kind of downward translation of the latch which is normally produced by the detacher magnet described above. Accordingly, persons seeking to overcome the security measures associated with the tag have sometimes used this approach to unlock the tag from an item of merchandise.

The inventive arrangements disclosed herein utilize special features associated with the latch and the plastic housing to provide a low cost solution that drastically reduces the possibility for unauthorized unlocking of an EAS tag by means of mechanical impact forces. The special features provide the ability to restrict the translation of the latch as it moves away from engagement with a locking pin by incorporating an obstructive feature into the housing at strategic location. Translation movement of the latch (as opposed to rotational movement) is the primary response due to a mechanical impact forces such as may occur by swinging and hitting the security tag on a hard surface. A motion trajectory of the latch can be predicted from the orientation the tag is likely hit. One or more special structures are provided in the housing and on the latch to disrupt the rapid translational movements of the latch that may result from such mechanical impact forces, thereby preventing unauthorized unlocking of the tag. In a slower moving detaching process (as would occur in the case of authorized detaching by means of a magnetic detacher) the latch will interact with the special structures on the housing initially but it will eventually be caused to move in a way that facilitates successful detaching. In some instances, the additional required movement may be further translational movement and in other scenarios the additional required movement can be a rotational movement of the latch.

Figure 2:
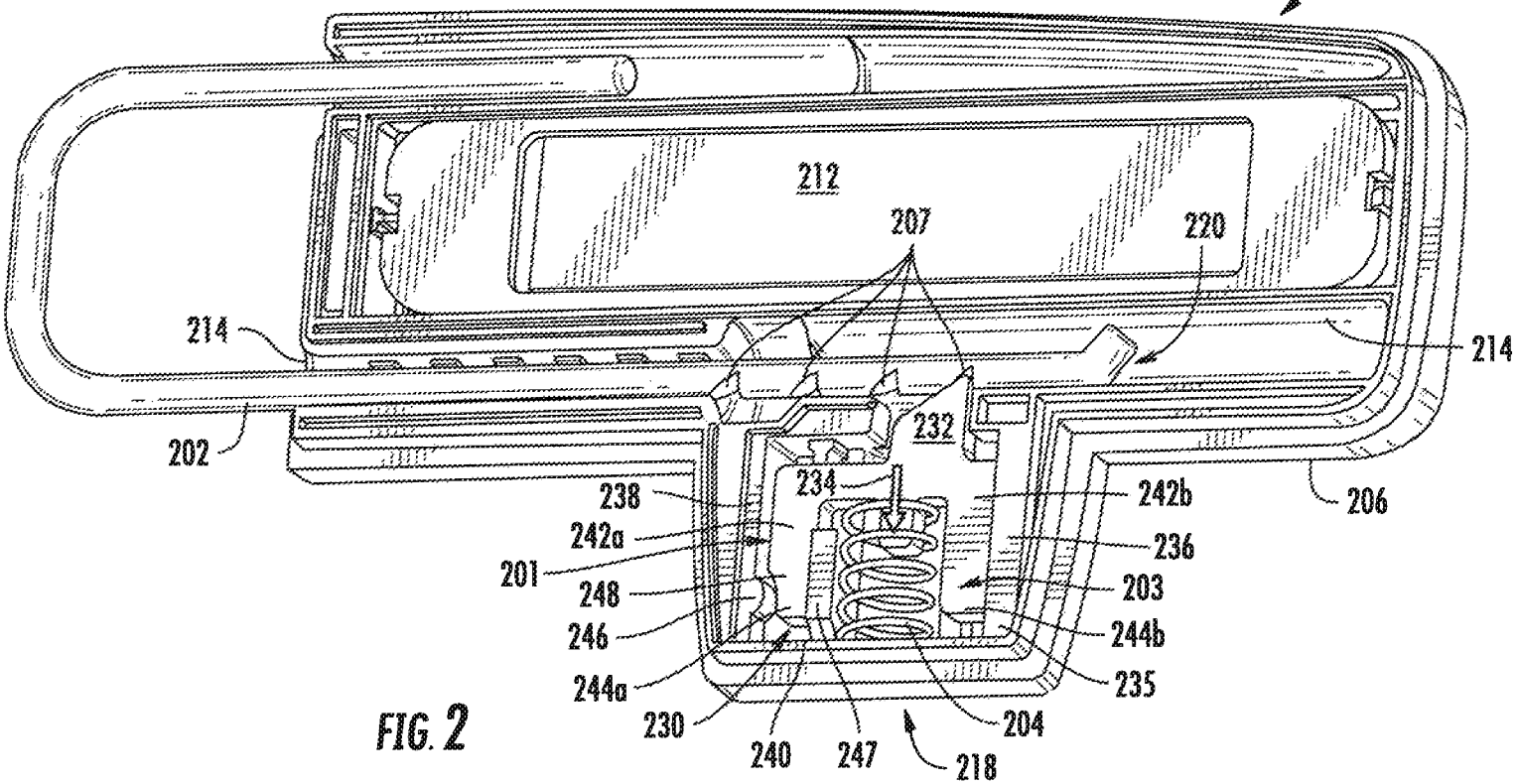
FIG. 2 is a cutaway view of a security tag with a latch in a locked position that is useful for understanding the inventive arrangements.

Referring now to FIG. 2, there is shown an enlarged view of a security tag 200. The security tag 200 is similar to the security tag 100. Accordingly, the description of the security tag 100 is generally sufficient for understanding the security tag 200, with the exception of the locking mechanism 201 which is described below in further detail. The security tag 200 includes a housing 206 in which the locking mechanism 201 is provided. The housing is formed of a rigid plastic material and houses a detectable element 212, such as a sensor, transponder, or electronic circuit that provides the EAS and or RFID function.

The housing 206 defines a latch channel 230 in which a latch 203 is movably disposed. The latch is formed of a material, such as steel, which is responsive to a magnetic field. Within the latch channel 230, the latch 203 is resiliently biased toward a movable locking element. In this example, the locking element is an elongated pin such as locking pin 202. As can be observed in FIG. 2, the locking pin 202 is slidably disposed for movement along a length of the pin channel 214. A resilient member, such as a spring 204 is disposed between the latch 203 and a portion of the housing 206 to provide the resilient bias as described herein.

In FIG. 2, the latch 203 is shown in a locked position in which movement of the locking element (e.g. locking pin 202) is prevented. In other words, the locking pin 202 is unable to move along a direction indicated by arrow 220 because it is held in place by the latch. In order to provide such locking engagement, the locking pin 202 has at least one catch 207 and the latch includes at least one tooth 232 which is aligned with a catch when the locking pin is moved to a certain position within the channel. As may be observed in FIG. 2, the tooth is advantageously sized and shaped to engage with a catch 207 when the latch 203 is in the locked position as shown. In some embodiments, the tooth can be shaped as a cog to selectively permit movement of the locking pin in only one direction when locked.

The latch 203 is movable within the latch channel responsive to application of a magnetic field (not shown). More particularly, when a magnetic detacher (not shown) is placed adjacent to a base portion 218 of the housing, the latch 203 is caused to move in a direction 234, away from the locking pin 202. When the latch 203 has moved a certain distance away from this locked position, the tooth 232 fully disengages from the catch 207 and the locking mechanism is considered unlocked. As such, the latch is movable between a locked position shown in FIG. 2, in which movement of the locking element is prevented by the latch, to an unlocked position shown in FIG. 3. In the unlocked position shown in FIG. 3, movement of the locking pin 202 is unrestricted by the latch 203.

Figure 3:
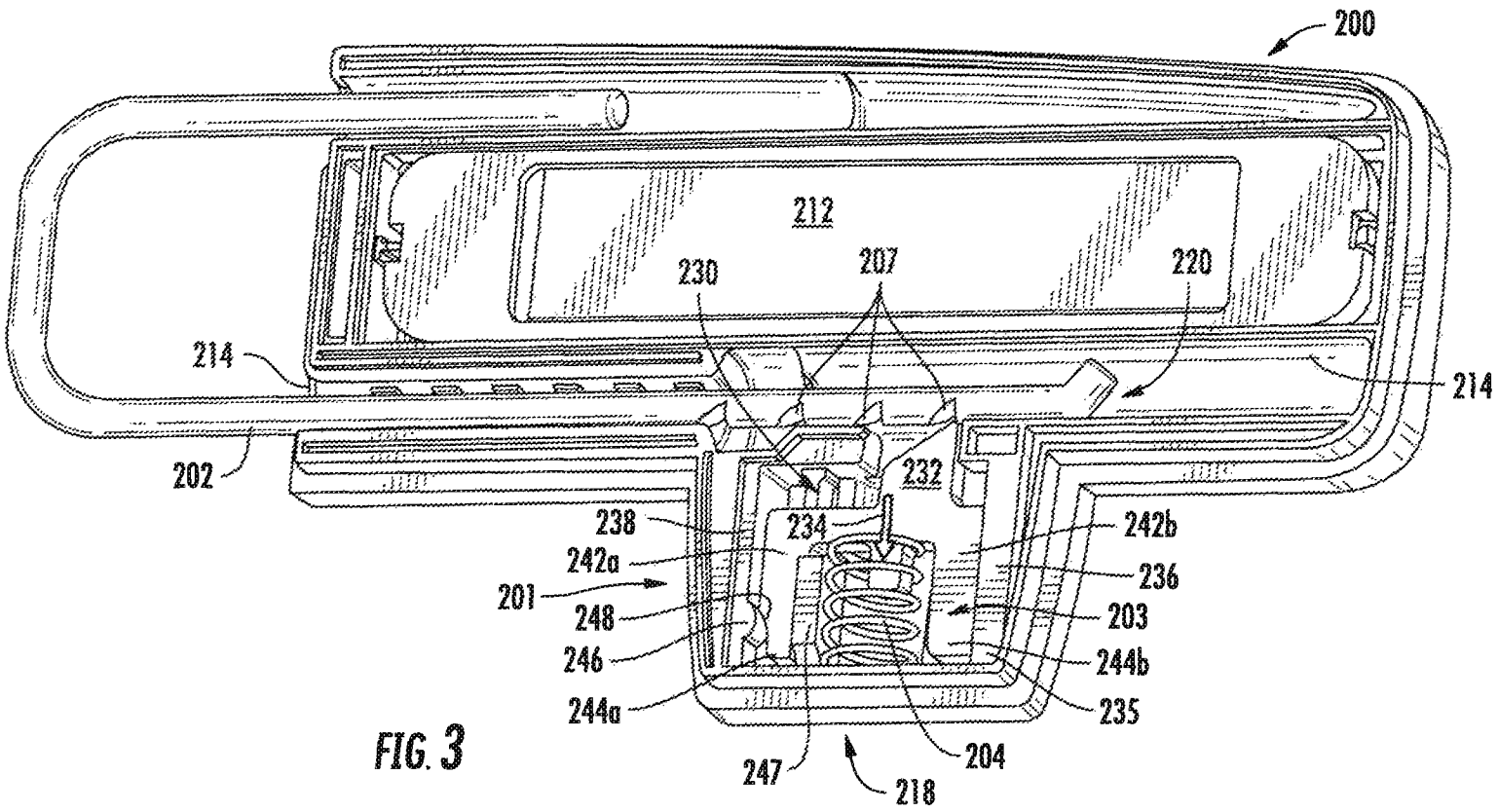
FIG. 3 is a cutaway view of the security tag in FIG. 2, with the latch in an unlocked position.

A guide structure 235 is provided within or as part of the security tag housing 206 and is arranged to constrain a movement of the latch 203. The guide structure includes one or more lateral restraints 236, 238. These lateral restraints are arranged to facilitate translational movement of the latch within the latch channel 230 along a path from the locked position to the unlocked position by constraining movement of the latch in a lateral direction transverse to such path. In an exemplary arrangement shown in FIGS. 2 and 3, the lateral restraints 236, 238 can be provided in the form of side walls which generally guide the movement of the latch as it moves between the locked and unlocked positions. These side walls can define the boundaries of the latch channel 230. A further portion of the guide structure is a stop 240. The stop 240 is positioned adjacent to the base 218 and in some scenarios can be integrally formed with the base. The stop 240 is arranged to limit the translational movement of the latch in a direction of travel 234 toward the unlocked position. The stop functions by engaging a portion of the latch. For example, as shown in FIGS. 2 and 3, the latch can have a pair of legs 242*a*, 242*b*. The stop 240 can function by engaging end portions 244*a*, 244*b* of the latch legs when the latch is in the fully unlocked position. In an exemplary embodiment shown in FIGS. 2 and 3, the stop can be formed as a channel end wall which together with the side walls (lateral restraints 236, 238) encloses the locking mechanism. As such, the guide structure 235 can effectively define a channel housing.

The guide structure 235 is generally arranged to prevent substantial lateral movement of the latch in direction 220. By restricting movement of the latch in this way, the locking pin 202 is similarly prevented from moving in direction 220 within the channel 214 whenever the latch is engaged with the locking pin. From the foregoing, it will be appreciated that the guide structure (and more particularly the lateral restraints 236, 238) described herein generally restrict movement of the latch in direction 220. Nevertheless, the lateral restraints 236, 238 permit latch movement in directions (e.g. direction 234) aligned with the length of the latch channel 230.

An unauthorized person desirous of defeating a security tag will sometimes repeatedly strike the security tag on a hard surface to generate a mechanical response of the latch that is similar to the response generated by an unlocking magnet. When the security tag is abused in this way, the physical mass of latch will cause the latch to have a motion trajectory within the security tag housing that mimics the motion obtained by application of an unlocking magnet. Under certain conditions, repeated striking of the security tag in this way can cause the tag to become unlocked as the latch travels along a motion trajectory in direction 234, away from the locking pin. A tag which can be defeated in this manner is obviously undesirable in EAS applications. In order to prevent defeat of the locking mechanism in this way, the latch 203 and the guide structure 235 are cooperatively arranged to facilitate engagement between at least one first disrupter portion of the guide structure and a second disrupter portion of the latch. These disrupter portions of the latch and the guide structure are strategically arranged to ensure that the engagement will disrupt a motion trajectory of the latch occurring when the housing is subjected to a physical impact. Consequently, the latch is selectively inhibited from moving fully from the locked position in FIG. 2 to the unlocked position in FIG. 3 when the housing is subjected to a physical impact as described herein. As used herein, inhibited means that the tendency of the latch to move to the unlocked position as a result of an impact is completely prevented or at least greatly suppressed as compared to conventional magnetic locking arrangements of the prior art.

The exact structure of the first and second disrupter portions is not critical provided that the structures are effective for accomplishing the motion disrupting action described herein. Referring once again to FIGS. 2 and 3, there is shown an exemplary first disrupter portion 246, 247 formed on the guide structure 235, and an exemplary second disrupter portion 248 formed on the latch 203. In some embodiments, a restricting element 247 can be included as part of the first disrupter portion to restrict a channel space in which the latch can move, and thereby urge the latch (as it moves in direction 234) into a position where the first disrupter portion engages the second disrupter portion. The restricting element 247 can be formed as a portion of the housing 206, as part of the guide structure 235, or can be attached within the latch channel by any suitable means.

In accordance with one embodiment of the invention, the first disrupter portion 246 comprises a bump or other protrusion extending into the latch channel 230 from the side wall of the channel housing or guide structure 235. For example, the first disrupter portion 246 can extend in a lateral direction from a side wall (i.e. lateral restraint 238) of the channel housing as shown. The first disrupter portion 246 is designed to interfere with or disrupt the downward translation of the latch as it moves in direction 234 in response to an impact of the security tag on a hard surface. In some embodiments, the first disrupter portion 246 can be provided as part of a lateral wall forming the channel 230 as shown. In this regard, the first disrupter portion can be formed as a part of the housing 206 (e.g. of the same material as the housing), or otherwise can be a separate component attachable to the housing, which may be of a different material than the housing, such as a metal rivet.

It can be observed in FIGS. 2 and 3 that the disrupter portion 246 is oriented or projects into the channel in a direction which is transverse to or approximately perpendicular to the direction 246. A motion trajectory of the latch when the security tag is stuck upon a hard surface can include translation along a direction 246 as described. As a result of such movement along this direction a second disrupter portion 248 formed on the latch will engage with the first disrupter portion to disrupt the movement of the latch in direction 246.

The disrupter portion 246 partially obstructs the downward translation of the latch 203 as would occur if abrupt external forces are applied to the tag, as when the tag is slammed against a hard surface in a defeat attempt. However, the second disrupter portion 248 is comprised of a contoured side of the latch 203 adjacent the first disrupter portion 246. The contour of the second disrupter portion 248 allows the latch to move downwardly past the protrusion formed by the first disrupter portion 246 under certain conditions. In particular, such movement is facilitated when the latch is introduced to a magnetic force of sufficient strength. In the illustrated embodiment, the latch 203 the second disrupter portion 248 is essentially formed as a contoured notch which is configured to have a shape which is partially complementary to the shape of the bump forming the first disrupter portion 246.

The notch formed by second disrupter portion 248 engages with the protrusion of first disrupter portion 246 when the latch is moved in direction 234. This engagement allows the downward translation of the latch 203 only if a steady, uninterrupted force is applied to the latch. Sudden external blows to the tag will not be sufficient to permit the bump to engage with and slide past the notch. In practice, a steady uninterrupted force can only be applied to the latch by the use of the detacher magnet in the detacher device. Accordingly, to unlock the locking mechanism 201, a detaching device is used (not shown) which is constructed and arranged to position a detacher magnet under the latch 203. The latch 203 is pulled downward in direction 234 by the magnetic force until it overcomes the bias of the spring 204 and allows the latch to transition through the engagement of the first and second disrupter portions as described. When the latch 203 finally translates to its fully unlocked position shown in FIG. 3, the tooth is released from the catch so that the pin 202 can be moved.

Figure 4:
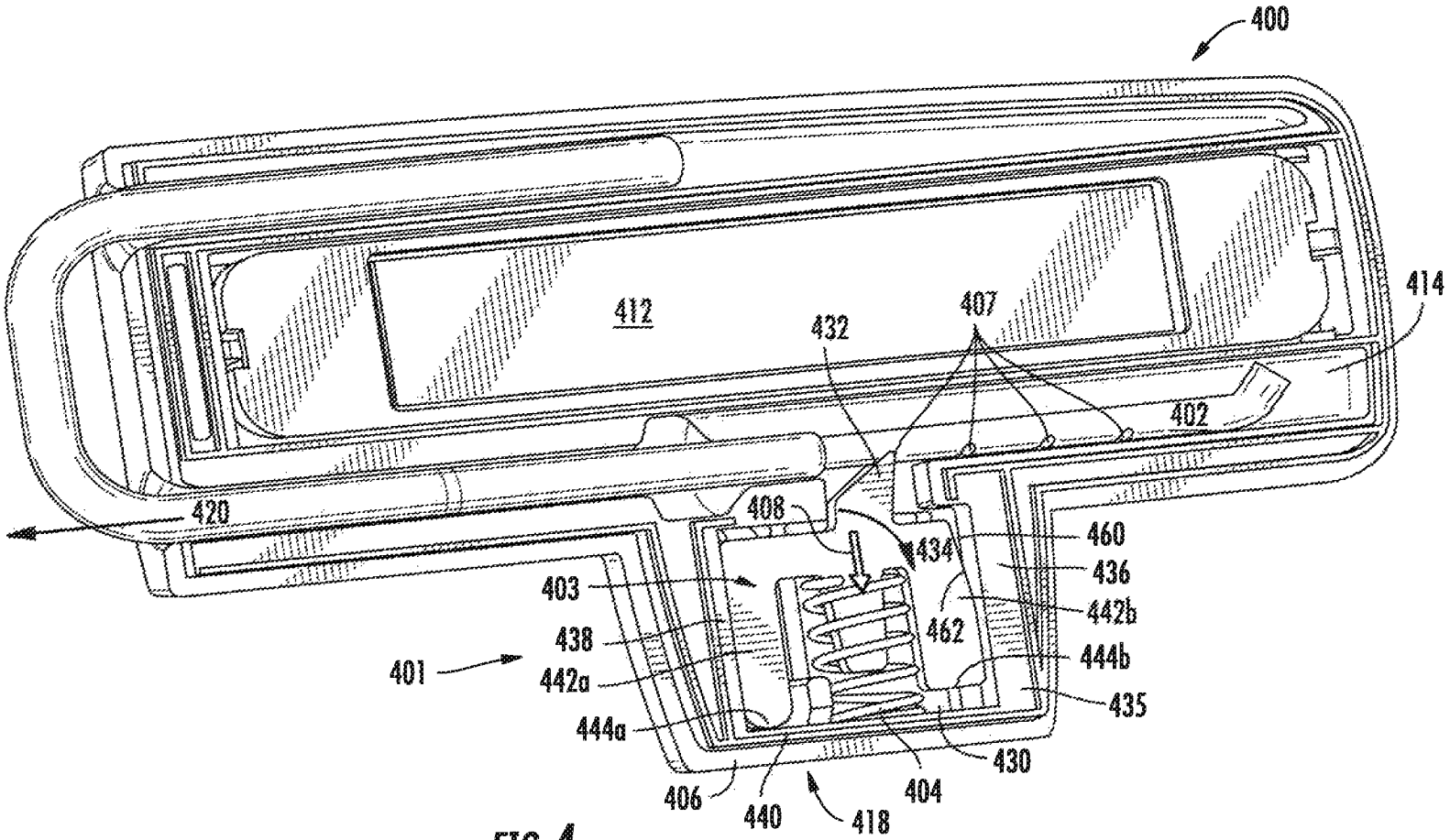
FIG. 4 is a cutaway view of a security tag, with a latch in a locked position, which is useful for understanding an alternative embodiment of the inventive arrangements.

Shown in FIG. 4, is an alternative embodiment of the invention wherein the motion of the latch necessary to effect unlocking involves a translation and rotation motion. Referring now to FIG. 4, there is shown an enlarged view of a security tag 400. The security tag 400 is similar to the security tag 200. Accordingly, the description of the security tag 200 is generally sufficient for understanding the security tag 200, with the exception of the locking mechanism 401 which is described below in further detail. The security tag 400 includes a housing 406 in which the locking mechanism 401 is provided. The housing is formed of a rigid plastic material and houses a detectable element 412, such as a sensor, transponder, or electronic circuit that provides the EAS and or RFID function.

The housing 406 defines a latch channel 430 in which a latch 403 is movably disposed. The latch is formed of a material, such as steel, which is responsive to a magnetic field. Within the latch channel 430, the latch 403 is resiliently biased toward a movable locking element. In this example, the locking element is an elongated pin such as locking pin 402. As can be observed in FIG. 4, the locking pin 402 is slidably disposed for movement along a length of the pin channel 414. A resilient member, such as a spring 404 is disposed between the latch 403 and a portion of the housing 406 to provide the resilient bias as described herein.

The latch 403 is movable between a locked position and an unlocked position. In FIG. 4, the latch 403 is shown in the locked position in which movement of the locking element (e.g. locking pin 402) is prevented. In other words, the locking pin 402 is unable to move along a direction indicated by arrow 420 because it is held in place by the latch. In order to provide such locking engagement, the locking pin 402 has at least one catch 407 and the latch includes at least one tooth 432 which is aligned with the catch when the locking pin is moved to a certain position within the channel. As may be observed in FIG. 4, the tooth is advantageously sized and shaped to engage with catch 407 when the latch 403 is in the locked position as shown. In some embodiments, the tooth can be shaped as a cog to selectively permit movement of the locking pin in only one direction when locked.

Figure 5:
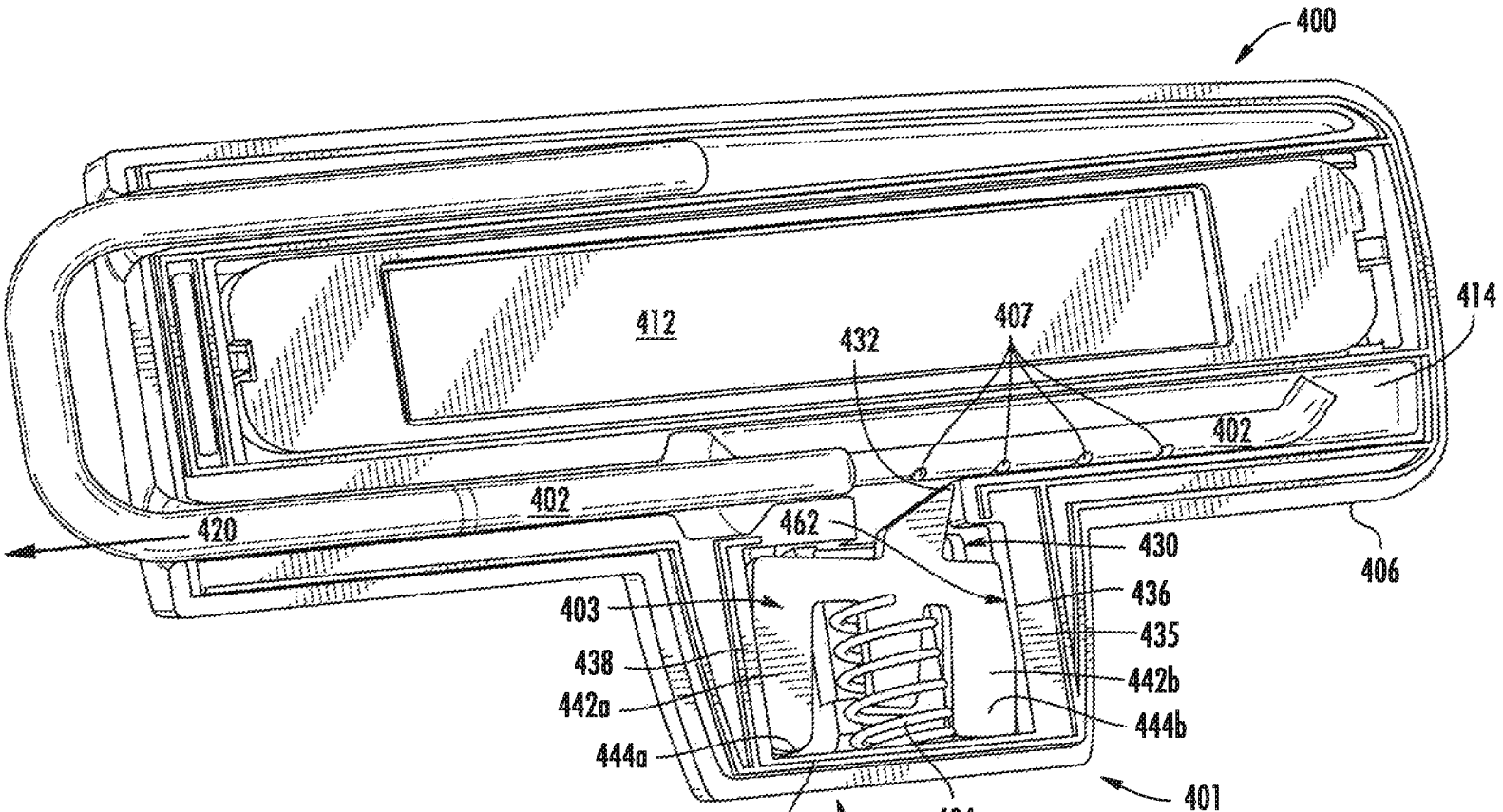
FIG. 5 is a cutaway view of the security tag in FIG. 4, with the latch in an unlocked position.

The latch 403 is movable within the latch channel responsive to application of a magnetic field (not shown). More particularly, when a magnetic detacher (not shown) is placed adjacent to a base portion 418 of the housing, the latch 403 is able to translate some distance in a direction 408. As shown in FIG. 4, the latch includes latch legs 442*a*, 442*b*, with latch leg 442*a* being longer than latch leg 442*b*. Accordingly, the latch will translate a certain distance in direction 408 until an end portion 444*a* of latch leg 442*a* engages a stop 440 associated with base portion 418. When this happens, further translational movement of the latch along direction 408 will be inhibited. However, due to the longer length of leg 442*a* as compared to leg 442*b* the latch will pivot or rotate about end portion 444*a* to provide rotational movement in the direction indicated by arrow 434. This rotational motion will ultimately result in the latch tooth 432 disengaging from the catch 407, thereby releasing the locking pin. Notably, the end portion 444*a* advantageously has a rounded end to facilitate the rotational motion described herein. FIG. 5 shows the latch in its unlocked position with the latch tooth 432 fully disengaged from the catch 407.

A guide structure 435 is provided within or as part of the security tag housing 406 and is arranged to constrain a movement of the latch 403. The guide structure includes one or more lateral restraints 436, 438. These lateral restraints are arranged to facilitate translational movement of the latch within the latch channel 430 along a path from the locked position to the unlocked position. This is accomplished by generally constraining movement of the latch in a lateral direction transverse to such path. However, the lateral restraints provide a sufficient clearance space 460 to allow for the rotational movement of the latch as described herein. The clearance space can be facilitated by a beveled or chamfered edge 462 which is defined on a portion of the latch adjacent to the lateral restraint 436. The chamfered edge 462 is formed on a portion of the latch diagonally opposed from end portion 444*a*. The chamfered edge 462 provides an additional clearance space between the latch and the lateral restraint 436 to permit the rotational movement of the latch in direction 434. Maximum rotation of the latch is reached when the chamfered edge engages the lateral restraint 436, or when the end portion 444*b* contacts the stop 440.

In an exemplary arrangement shown in FIGS. 4 and 5, the lateral restraints 436, 438 can be provided in the form of side walls which generally guide the movement of the latch as it moves between the locked and unlocked positions. These side walls can define the boundaries of the latch channel 430. A further portion of the guide structure is the stop 440. The stop 440 is positioned adjacent to the base 418 and in some scenarios can be integrally formed with the base. As noted above, the stop 440 is arranged to limit the translational movement of the latch in a direction of travel 408 toward the unlocked position. The stop functions by engaging a portion of the latch, such as end portion 444*a*. In an exemplary embodiment shown in FIGS. 4 and 5, the stop can be formed as a channel end wall which together with the side walls (lateral restraints 436, 438) encloses the locking mechanism. As such, the guide structure 435 can effectively define a channel housing.

The guide structure 435 is generally arranged to prevent substantial lateral movement of the latch in direction 420. By restricting movement of the latch in this way, the locking pin 402 is similarly prevented from moving in direction 420 within the channel 414 whenever the latch is engaged with the locking pin. From the foregoing, it will be appreciated that the guide structure (and more particularly the lateral restraint 438) described herein generally restricts movement of the latch in direction 420. Nevertheless, the lateral restraints 436, 438 provide a sufficient clearance space 460 to facilitate translational latch movement in directions aligned with the length of the latch channel 430 (direction 408) and rotational latch movement in direction 434.

As noted above, repeated striking of a conventional security tag in a certain way can cause the tag to become unlocked. In security tag 400, the latch 403 and the guide structure 435 are cooperatively arranged to prevent defeat of the locking mechanism in this way. When the base 418 of security tag 400 is impacted upon a hard surface, the impact and the physical mass associated with latch 403 will launch the latch along a motion trajectory. This motion trajectory will generally include motion components directed along the length of the latch channel (i.e. in direction 408). In a conventional magnetic lock, this motion trajectory might result in the latch moving from a locked position to an unlocked position. However, in the security tag 400, the end portion 444*a* of elongated latch leg 442*a* and stop 440 are cooperatively arranged to disrupt a motion trajectory of the latch occurring when the housing 406 is subjected to such physical impact. More particularly, after an impact, the latch may begin a motion trajectory in a direction 408. But the stop 440 is positioned so that the motion of the latch is disrupted before the tooth 432 can disengage from the catch 407. The stop 440 will produce a counter-acting force to re-direct the motion trajectory of the latch. The re-directed motion trajectory will include motion components directed away from the stop and toward the locking pin 402. These motion components will cause the latch to essentially bounce back toward the locking pin.

Due to the longer length of leg 442*a*, the impact with the stop can introduce some torque upon the latch in rotational direction 434. However, in contrast to when there is a continuous force upon the latch exerted by an applied magnetic field, the momentary torque produced by the impact of end portion 444*a* and stop 440 is not generally sufficient to allow the locking pin to be released. Instead, it has been observed that the response of the latch after disruptive interaction of the end portion 444*a* and stop 440 involves further disruptive interaction as between the catch 407 and the tooth 432. The disruptive interactions prevent the latch from fully rotating out of engagement with the locking pin. It has been observed that in some instances there will be a momentary disengagement of the tooth with the catch, followed by immediate re-engagement as the latch rotates back into its locked position. However, the overall resistance to unlocking is greatly improved as compared to a conventional locking arrangement. Accordingly, the latch is selectively inhibited from moving fully from the locked position to the unlocked position when the housing is subjected to the physical impact.

In the exemplary embodiment in FIGS. 4 and 5, the unequal lengths of the two legs of the latch serve to impart rotation to the latch 403 when the latch is introduced to the magnetic detacher. In other embodiments, the rotational response is achieved by configuring the latch to have a magnetic imbalance, for example, by varying the materials of different portions of the latch. When the latch is subjected to the detacher field, the latch will rotate in the direction indicated (direction 434) due to physical restrictions on a portion of the latch, or due to the torque introduced by the imbalance in the magnetic response. This rotation will enable the latch tooth 432 to rotate clear of the catch 407, thereby allowing the pin to be extracted. In such a scenario, the latch and the guide structure can have a different point of engagement to facilitate the re-direction of a latch motion trajectory as described herein. In such an embodiment, all that is needed is engagement between at least one portion of the guide structure and a portion of the latch that is sufficient to disrupt a motion trajectory of the latch occurring when the housing is subjected to a physical impact.

The inventive arrangements have thus far been described in terms of a security tag device. However, it should be appreciated that the invention also concerns a method for preventing defeat of a security tag as described herein. As such the method involves selectively disrupting with one or more portions of a guide structure 235, 435 a motion trajectory of the latch occurring when the housing 206, 406 is subjected to a physical impact. More particularly, the method involves selectively preventing the latch 203, 403 from moving fully from the locked position to the unlocked position only when the housing is subjected to the physical impact. In the embodiments disclosed in FIGS. 2-5, the latch is capable of repeatedly and consistently moving from the locked position to the unlocked position when subjected to a continuously applied magnetic field. However, the same result cannot be produced when the security tag is subjected to a physical impact due to the motion disrupting engagement of the guide structure 235, 435 with the latch 203, 403. In such scenarios, the kinetic energy of the latch associated with an impact produced motion trajectory is effectively re-oriented or re-directed along a different path. The re-directed energy is eventually wasted within the housing (e.g. as heat) as the kinetic energy of the latch is re-directed along various different vector that are ineffective for producing an unlocking effect.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

What is claimed is:

1. A tamper-resistant security tag comprising:

a housing;

a locking element movably disposed within the housing;

a latch disposed within the housing and movable responsive to application of a magnetic field between a locked position, in which movement of the locking element is prevented by the latch, and an unlocked position, in which movement of the locking element is unrestricted by the latch;

a resilient member arranged to resiliently bias the latch in a direction toward the locked position;

a guide structure within the housing arranged to constrain a movement of said latch;

a first disrupter structure formed on the latch;

a second disrupter structure formed on a portion of the guide structure at a location in which the first and second disruptor structures are at least partially aligned with each other when the latch is in the locked position;

wherein said first and second disrupter structures each have a respective shape and position which in combination are configured to disrupt a motion trajectory of the latch as it moves from the locked position toward the unlocked position in response to the housing being subjected to a physical impact, whereby the latch is selectively inhibited from moving fully from the locked position to the unlocked position when the housing is subjected to the physical impact, and to selectively facilitate at least a portion of an unlocking movement of the latch in which said latch transitions fully from the locked position to the unlocked position in response to an applied magnetic field.

2. The tamper-resistant security tag according to claim 1, wherein the resilient member is comprised of a spring disposed between the latch and the housing, said spring arranged to urge said latch toward said locking member.

3. The tamper resistant security tag according to claim 1, wherein the housing further includes a channel and the locking element is comprised of an elongated pin movably disposed in the channel.

4. The tamper resistant security tag according to claim 3, wherein the elongated pin has at least one catch and the latch includes one tooth which is aligned with the catch when said elongated pin is moved to a certain position within the channel, said tooth sized and shaped to engage with the catch when the latch is in the locked position.

5. The tamper resistant security tag according to claim 4, wherein the guide structure is arranged to constrain a movement of the latch to a direction aligned with the channel, whereby movement of the elongated pin within the channel is constrained when the latch is in the locked position.

6. The tamper resistant security tag according to claim 1, wherein the latch is formed of a material that is responsive to an applied magnetic field.

7. The tamper resistant security tag according to claim 1, wherein the guide structure includes one or more lateral restraints arranged to facilitate translational movement of the latch within a latch channel along a path from the locked position to the unlocked position by constraining movement of the latch in a lateral direction transverse to the path.

8. The tamper resistant security tag according to claim 7, wherein the second disrupter structure is a protrusion disposed on at least one of the lateral restraints, said protrusion extending into the latch channel a certain distance along said lateral direction to engage the first disrupter structure.

9. The tamper resistant security tag according to claim 8, wherein the first disrupter structure is a contoured surface of said latch which is shaped so as to urge the latch in the lateral direction when the latch is moved along the path from the locked position to the unlocked position responsive to application of the magnetic field.

10. The tamper resistant security tag according to claim 7, wherein the second disrupter structure is a stop, said stop positioned and arranged to limit the translational movement of the latch in a direction of travel toward the unlocked position by engaging the first disrupter structure of the latch as said latch moves toward the unlocked position.

11. A tamper-resistant security tag comprising:

a housing;

a locking element movably disposed within the housing;

a latch disposed within the housing and movable responsive to application of a magnetic field between a locked position, in which movement of the locking element is prevented by the latch, and an unlocked position, in which movement of the locking element is unrestricted by the latch;

a resilient member arranged to resiliently bias the latch in a direction toward the locked position;

a guide structure within the housing arranged to constrain a movement of said latch;

a first disrupter structure formed on the latch;

a second disrupter structure formed on a portion of the guide structure and arranged to engage said first disrupter structure;

wherein said first and second disrupter structure each have a respective shape and position which in combination are configured to disrupt a motion trajectory of the latch as it moves from the locked position toward the unlocked position in response to the housing being subjected to a physical impact, whereby the latch is selectively inhibited from moving fully from the locked position to the unlocked position when the housing is subjected to the physical impact, and to selectively facilitate at least a portion of an unlocking movement of the latch in which said latch transitions fully from the locked position to the unlocked position in response to an applied magnetic field wherein the guide structure includes one or more lateral restraints arranged to facilitate translational movement of the latch within a latch channel along a path from the locked position to the unlocked position by constraining movement of the latch in a lateral direction transverse to the path;

wherein the second disrupter structure is a stop, said stop positioned and arranged to limit the translational movement of the latch in a direction of travel toward the unlocked position by engaging the first disrupter structure of the latch as said latch moves toward the unlocked position; and wherein the stop is positioned at an end of the latch channel opposed from the locking element, and wherein first disrupter structure is shaped to pivot on the second disrupter structure to facilitate rotation of the latch about a latch pivot axis when the stop has engaged the portion of the latch and the latch is subjected to the magnetic field.

12. A tamper-resistant security tag comprising:

a housing;

a locking element movably disposed within the housing;

a latch disposed within the housing and movable responsive to application of a magnetic field between a locked position, in which movement of the locking element is prevented by the latch, and an unlocked position, in which movement of the locking element is unrestricted by the latch;

a resilient member arranged to resiliently bias the latch in a direction toward the locked position;

a guide structure within the housing which constrains a movement of said latch includes one or more lateral restraints which facilitate translational movement of the latch within a latch channel along a path from the locked position to the unlocked position by constraining movement of the latch in a lateral direction transverse to the path, and a stop positioned at an end of the latch channel opposed from the locking element, the stop disposed to limit the translational movement of the latch in a direction of travel toward the unlocked position by engaging a portion of the latch;

wherein the stop and at least one of the lateral restraints is arranged to facilitate rotation of the latch about a latch pivot axis when the stop has engaged the portion of the latch and the latch is subjected to the magnetic field, said engaging disrupting a motion trajectory of the latch occurring when the housing is subjected to a physical impact, whereby the latch is selectively inhibited from moving fully from the locked position to the unlocked position when the housing is subjected to the physical impact.

13. The tamper resistant security tag according to claim 1, wherein the shape and position of the second disrupter structure are arranged to cause the second disrupter structure to exert an impact force directed upon the portion of the latch when said latch is approaching the unlocked position in response to the physical impact upon the housing.

14. A tamper-resistant security tag comprising:

a housing;

a movable locking element disposed within the housing;

a latch disposed within the housing and resiliently biased toward the movable locking element, the latch movable responsive to application of a magnetic field between a locked position, in which movement of the locking element is prevented by the latch, and an unlocked position, in which movement of the locking element is unrestricted by the latch;

a guide structure within the housing arranged to constrain a movement of said latch;

a first disrupter structure comprised of a concave surface formed on the latch;

a second disrupter structure comprised of a protrusion formed on a portion of the guide structure at a location in which the first and second disruptor structures are at least partially aligned with each other when the latch is in the locked position, where the second disrupter structure positioned to engage the concave surface of the first disrupter structure as said latch approaches the unlocked position;

wherein the concave surface and the protrusion are sized and shaped to disrupt a motion trajectory of the latch occurring when the housing is subjected to a physical impact, whereby the latch is selectively inhibited from moving fully from the locked position to the unlocked position when the housing is subjected to the physical impact, and to facilitate an unlocking movement of the latch in which said latch transitions fully from the locked position to the unlocked position in response to an applied magnetic field.

15. A method for preventing defeat of a security tag, comprising:

disposing within a housing of the security tag a latch which is resiliently biased toward a movable locking element, and movable responsive to application of a magnetic field between a locked position, in which movement of the locking element is prevented by the latch, and an unlocked position, in which movement of the locking element is unrestricted by the latch;

providing a guide structure within the housing to constrain a movement of said latch along a translational path defined by the guide structure, where the guide structure has a first disruptor structure formed thereon at a location in which the first disruptor structure is at least partially aligned with a second disruptor structure formed on the latch;

disrupting with the first and second disruptor structures a motion trajectory of the latch as it travels along the translational path in response to a physical impact upon the housing so that the latch is selectively inhibited from moving fully from the locked position to the unlocked position when the housing is subjected to a physical impact; and guiding an unlocking movement of the latch with the guide structure in which said latch transitions fully from the locked position to the unlocked position in response to an applied magnetic field.

16. The method according to claim 15, further comprising disrupting the motion trajectory by arranging at least one portion of the guide structure to impact a portion of the latch during said motion trajectory.

17. The method according to claim 15, arranging said impact so that it produces an altered motion trajectory for said latch.

18. The method according to claim 17, wherein the altered motion trajectory contains one or more disruptive motion components which prevent said latch from moving fully from the locked position to the unlocked position by wasting available kinetic energy of the latch.

19. The method according to claim 17, wherein said altered motion trajectory includes disruptive motion components which are transverse to a direction of the motion trajectory.

20. The method according to claim 17, wherein the altered motion trajectory includes disruptive motion components in a direction opposed to a direction of the motion trajectory.

* * * * *